US005409884A

United States Patent [19]

Harada et al.

[11] Patent Number: 5,409,884

[45] Date of Patent: Apr. 25, 1995

[54] THERMAL IMAGE TRANSFER RECORDING MEDIUM

[75] Inventors: Shigeyuki Harada, Mishima; Keishi Taniguchi, Susono; Yoichi Iwaki, Owari; Yutaka Sakai, Aichi; Shigekazu Teranishi, Nagoya; Susumu Kawakami; Hironori Hata, both of Aichi, all of Japan

[73] Assignee: Ricoh Company, Ltd., Tokyo, Japan

[21] Appl. No.: 214,101

[22] Filed: Mar. 17, 1994

[30] Foreign Application Priority Data

Mar. 17, 1993 [JP] Japan ..... 5-084016

[51] Int. Cl.[6] ..... B41M 5/035; B41M 5/38

[52] U.S. Cl. ..... 503/227; 428/195; 428/447; 428/488.4; 428/535; 428/913; 428/914

[58] Field of Search ..... 8/471; 428/195, 447, 428/488.4, 535, 913, 914; 503/227

[56] References Cited

U.S. PATENT DOCUMENTS

| | | | |
|---|---|---|---|
| 4,486,763 | 12/1984 | Taniguchi et al. | 503/209 |
| 4,502,068 | 2/1985 | Taniguchi et al. | 503/216 |
| 4,506,278 | 3/1985 | Sakamoto et al. | 503/216 |
| 4,511,910 | 4/1985 | Taniguchi et al. | 503/216 |
| 4,517,580 | 5/1985 | Iiyama et al. | 503/214 |
| 4,608,579 | 8/1986 | Taniguchi | 503/209 |
| 4,636,819 | 1/1987 | Nagamoto et al. | 503/216 |
| 4,731,354 | 3/1988 | Taniguchi et al. | 503/209 |
| 4,978,709 | 12/1990 | Taniguchi et al. | 524/606 |
| 4,983,446 | 1/1991 | Taniguchi et al. | 428/216 |
| 5,248,543 | 9/1993 | Yamaguchi et al. | 428/195 |
| 5,260,139 | 11/1993 | Shiraishi et al. | 428/488.1 |
| 5,260,255 | 11/1993 | Sudo et al. | 503/227 |
| 5,296,439 | 3/1994 | Maruyama et al. | 503/201 |
| 5,306,687 | 4/1994 | Furuya et al. | 503/207 |

*Primary Examiner*—B. Hamilton Hess

*Attorney, Agent, or Firm*—Oblon, Spivak, McClelland, Maier & Neustadt

[57] ABSTRACT

A thermal image transfer recording medium is composed of a support, a thermal image transfer ink layer formed thereon, and a heat resistant protective layer which is composed of a cellulose-modified polymer with a backbone polymer thereof being cellulose and/or a cellulose derivative and a branch polymer thereof being a copolymer of a reactive silicone oil and a vinyl monomer, and which is formed on the back side of the support opposite to the thermal image transfer ink layer with respect to the support.

8 Claims, No Drawings

THERMAL IMAGE TRANSFER RECORDING MEDIUM

BACKGROUND OF THE INVENTION

1. Field of the Invention

The present invention relates to a thermal image transfer recording medium, which is free from sticking phenomenon and blocking phenomenon, and has excellent preservability and printing performance.

2. Discussion of Background

In a conventional thermal image transfer recording system, an image receiving sheet is superimposed on a thermal image transfer recording medium which comprises a support and a thermal image transfer ink layer formed thereon in such a manner that the image receiving sheet is brought into pressure contact with the thermal transfer ink layer, a thermal head is brought into contact with the back side of the support which is opposite to the thermal image transfer ink layer, and the thermal head is heated with the application of a pulse-shaped signal current thereto, whereby the thermal image transfer ink layer is imagewise fused or sublimated to form images on the image receiving sheet.

In a thermal fusing image transfer system, in particular when black color printing is performed, a thermal image transfer recording medium with an ink layer which contains carbon black is employed.

Furthermore, in the case of color printing, three separate thermal transfer recording media with primaries, yellow, magenta and cyan, are prepared and colored images are printed by successively superimposing these thermal transfer recording media on an image receiving sheet.

In a thermal sublimation image transfer system, the amount of a sublimable ink to be sublimated is controlled by the amount of thermal energy applied thereto by a thermal head, so that image density gradation printing can easily be performed. Specifically, images with high density can be printed by increasing the voltage to be applied to the thermal head or the length of the application time of the current pulses applied thereto, and images with low density are printed by decreasing the voltage to be applied to the thermal head or the length of the application time of current pulses. Color printing can be performed in the same manner as by the thermal fusing image transfer system, and color printing with image density gradation can be performed by changing the amount of thermal energy applied by the thermal head.

As the material for the support of a thermal fusing image transfer medium and a sublimation type thermal image transfer medium, plastics films such as a polyethylene terephthalate (PET) film are in general use. However, when plastics films such as a PET film are employed as the support, a portion of the film with which a thermal head comes into contact is fused by the heat applied thereto through the thermal head, and is stuck on the thermal head during an image transfer step. The result is that the recording medium cannot be transferred at a stable speed. When this sticking phenomenon takes place, not only the printing quality is considerably degraded, but also the fused film makes a big noise when it is peeled away from the thermal head, or the transportation of the recording medium is stopped by the thermal head to which the fused film adheres, or the recording medium is broken by the thermal head.

In order to prevent this sticking phenomenon, there have been proposed various methods of providing a heat resistant protective layer on one side of the support of the recording medium with which a thermal head comes into contact, that is, on the side opposite to the thermal image transfer ink layer.

For example, Japanese Laid-Open Patent Applications 55-7467 and 63-172688 propose the provision of a heat resistant protective layer comprising silicone resin, epoxy resin, melamine resin, phenolic resin, fluorine plastics, polyimide resin, polyamide resin, or cellulose resin, on one side of the support.

Furthermore, Japanese Laid-Open Patent Application 60-201989 proposes the provision of a heat resistant protective layer comprising an aromatic polyamide; and Japanese Laid-Open Patent Application 63-203387 proposes the provision of a heat resistant protective layer comprising an aromatic polysulfone resin.

These heat resistant protective layers, however, cannot prevent the occurrence of the sticking phenomenon sufficiently for use in practice, and when a thermal image transfer recording medium with such a heat resistant protective layer is preserved in the form of a roll, the heat resistant protective layer and the thermal image transfer ink layer of the thermal image transfer recording medium stick together, that is, the so-called blocking phenomenon takes place.

When such a blocking phenomenon takes place, the thermal image transfer recording medium in the form of a roll cannot be transferred smoothly, and ink components from the ink layer are transferred to the heat resistant protective layer and fixed thereon, and are then transferred to, deposited on, or fixed on a heating element portion of a thermal head and its vicinity, so that printing quality obtained is significantly degraded.

Japanese Laid-Open Patent Application 61-143195 proposes the provision of a back coat layer (i.e. a heat resistant protective layer) which comprises a silicone graft copolymer or a block acrylic copolymer. The back coat layer comprises a silicone graft copolymer or a block acrylic copolymer and has excellent slip properties, and therefore an ant-sticking performance, and excellent heat resistant performance and anti-blocking performance. However, the silicone graft copolymer and block acrylic copolymer are poor in film formation properties, so that when continuous printing is performed, the surface portion of the back coat layer comprising such a copolymer is scraped therefrom by a thermal head, and scraped components from the back coat layer are fused and adhere to a heating element of the thermal head and its vicinity. As a result, the printing quality obtained is significantly degraded in the same manner as when the blocking phenomenon takes place. In order to obtain excellent printing quality, the thermal head must be cleaned very frequently, but this is troublesome.

Furthermore, Japanese Laid-Open Application 1-221281 proposes a thermal image transfer recording medium with the provision of a heat resistant protective layer comprising an ethyl cellulose resin with the addition of silicone oil and/or additives such as a surfactant on an ink layer. This method, however, has the shortcoming that the silicone oil and/or additives such as a surfactant are transferred to the ink layer while the recording medium is allowed to stand at high temperatures or preserved for a long period of time, and the transferred silicone oil and/or additives to the ink layer cause non-uniform image transfer and imperfect image transfer with the formation of non-printed portions, so that obtained printing quality is significantly degraded. This shortcoming is the same as that of a method of providing a resin layer which contains, for instance, a solid or semi-solid surfactant, which is disclosed in Japanese Laid-Open Patent Application 57-129789.

Japanese Laid-Open Patent Application 1-234292 discloses the provision of a heat resistant protective layer comprising an acetate-group-containing cellulose ester resin or this cellulose ester resin with the addition of silicone oil thereto. This protective layer, however, still has the same shortcomings as in the heat resistant protective layers disclosed in Japanese Laid-Open Patent Applications 55-7467 and 63-172688, and Japanese Laid-Open Patent Application 1-221281.

As mentioned above, varieties of a heat resistant protective layer for a thermal image transfer recording medium have been proposed, but most of them still have the shortcomings that transfer performance becomes poor, a thermal head is abraded, the support of the recording medium is broken, which degrades printing quality, when printing is carried out continuously for an extended period of time; and the anti-blocking performance and prevention of the formation of thermal head dust are insufficient for use in practice.

SUMMARY OF THE INVENTION

It is therefore a first object of the present invention to provide a thermal image transfer recording medium with a heat resistant protective layer, which is capable of sufficiently preventing the occurrence of the sticking phenomenon.

A second object of the present invention is to provide a thermal image transfer recording medium with a heat resistant protective layer, which is free from the problems that components from the heat resistant protective layer thereof are transferred to an ink layer thereof and the blocking phenomenon takes place when the thermal image transfer recording medium is in the shape of a roll and preserved for an extended period of time or at high temperatures.

A third object of the present invention is to provide a thermal image transfer recording medium with a heat resistant protective layer, which is capable of providing excellent printing performance, without a surface portion of the heat resistant protective layer being scraped off the heat resistant protective layer by the friction with a thermal head.

A fourth object of the present invention is to provide a thermal image transfer recording medium with a heat resistant protective layer, which is capable of preventing the occurrence of the sticking phenomenon and is free from the problems that components from the heat resistant protective layer are transferred to an ink layer thereof and the blocking phenomenon takes place when the thermal image transfer recording medium is used in high speed printers.

These objects of the present invention can be achieved by a thermal image transfer recording medium comprising a support, a thermal image transfer ink layer formed thereon, and a heat resistant protective layer which comprises a cellulose-modified polymer with a backbone polymer thereof being cellulose and/or a cellulose derivative and a branch polymer thereof being a copolymer of a reactive silicone oil and a vinyl monomer and which is formed on the back side of the support opposite to the thermal image transfer ink layer with respect to the support.

DESCRIPTION OF THE PREFERRED EMBODIMENTS

The thermal image transfer recording medium of the present invention comprises a support, a thermal image transfer ink layer formed thereon, and a heat resistant protective layer which comprises a cellulose-modified polymer with a backbone polymer thereof being cellulose and/or a cellulose derivative and a branch polymer thereof being a copolymer of a reactive silicone oil and a vinyl monomer, and which is formed on the back side of the support opposite to the thermal image transfer ink layer with respect to the support.

The present invention is based on the discovery that the above-mentioned cellulose-modified polymer is suitable for a material for the heat resistant protective layer of the thermal image transfer recording medium.

Specific examples of cellulose and a cellulose derivative for use in the present invention include: cellulose, nitrocellulose, cellulose acetate, cellulose acetate propionate, cellulose acetate butyrate, ethyl cellulose, hydroxyethyl cellulose, ethylhydroxy ethyl cellulose, hydroxypropyl cellulose, hydroxypropyl ethyl cellulose, carboxymethyl cellulose, and carboxymethyl ethyl cellulose.

Of the above-mentioned cellulose and cellulose derivatives, cellulose acetate propionate, cellulose acetate butyrate, and ethyl cellulose are preferable for use in the present invention in view of their solubility in solvents, safety while in use, and heat resistance.

The above-mentioned cellulose and cellulose derivatives can be used alone or in combination.

As the reactive silicone oil for use in the present invention, silicone compounds of the following formula (I) or formula (II), with functional groups such as hydroxyl group or epoxy group being provided as an end group thereof, and polydialkyl siloxane with a radical polymerizable unsaturated group being provided as another end group thereof:

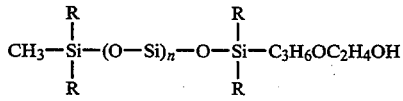

(I)

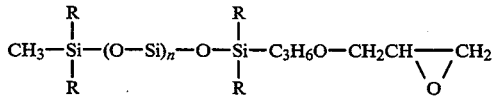

(II)

wherein R is phenyl group or methyl group, and n is an integer of 10 to 200.

It is preferable that the reactive silicone oil for use in the present invention have a molecular weight in the range of about 500 to 3000.

As the vinyl monomer for use in the present invention, a vinyl monomer which is copolymerizable with the previously mentioned cellulose and/or cellulose derivatives and with the previously mentioned reactive silicone oil is employed.

Specific examples of such a vinyl monomer for use in the present invention include: methyl acrylate, ethyl acrylate, n-butyl acrylate, iso-butyl acrylate, 2-ethylhexyl acrylate, cyclohexyl acrylate, tetrahydrofurfuryl acrylate, methyl methacrylate, ethyl methacrylate, n-butyl methacrylate, iso-butyl methacrylate, 2-ethylhexyl methacrylate, stearyl methacrylate, lauryl methacrylate, methyl vinyl ether, ethyl vinyl ether, n-propyl vinyl ether, n-butyl vinylether, iso-butyl vinylether, styrene, α-methylstyrene, acrylonitrile, methacrylonitrile, vinyl acetate, vinyl chloride, vinylidene chloride, vinyl fluoride, vinylidene fluoride, 2-hydroxyethylacrylate, 2-hydroxyethylacrylate, 2-hydroxypropylacrylate, 2-hydroxypropylacrylate, allyl alcohol, glycidyl allylate, glycidyl methacrylate, glycidyl allyl ether, acrylic acid, methacrylic acid, itaconic acid, crotonic acid, maleic acid, maleic anhydride, citraconic acid, acrylamide, methacrylamide, N-methylolacrylamide, and N-methylolmethacrylamide. These vinyl monomers can be used alone or in combination.

The cellulose-modified polymer for use in the present invention is usually produced by solution polymerization. In the solution polymerization, aromatic hydrocarbon solvents such as toluene and xylene; ketone solvents such as acetone, methyl ethyl ketone, and methyl butyl ketone; ester solvents such as ethyl acetate, and butyl acetate; and alcohol solvents such as ethanol and isopropanol can be employed alone or in combination.

Furthermore, in this solution polymerization, an oil-soluble initiator is employed. Examples of such an oil-soluble initiator are benzoyl peroxide, lauroyl peroxide, cumene hydroperoxide, azobisisobutyronitrile, and azobisvaleronitrile.

Graft copolymerization of a branch polymer with the cellulose and/or cellulose derivative serving as a backbone polymer is carried out by either a method (A) of utilizing a hydrogen-pull reaction, or a method (B) of providing cellulose with a grafting active site.

In the method utilizing a hydrogen-pull reaction, it is preferable to employ an initiator having a strong hydrogen pulling effect in the presence of a cellulose derivative. Examples of such an initiator are organic peroxides such as benzoyl peroxide, dicumyl peroxide, t-butylperoxi-isopropylcarbonate, t-amyl-perbenzoate, t-butylperbenzoate, di-t-butylperoxide, and bis(t-butylperoxiisopropyl) benzene.

As the method (B) of providing cellulose with a grafting active site, for example, a method of allowing a vinyl monomer having a functional group which is capable of reacting with a hydroxyl group of cellulose and/or cellulose derivative, such as carboxyl group or isocyanate group, to react with the hydroxyl group of cellulose and/or cellulose derivative, whereby a double bond is introduced into the cellulose and/or cellulose derivative for grafting the cellulose and/or cellulose derivative, is effective as described in Japanese Laid-Open Patent Application 63-182302.

Specific examples of a vinyl monomer having carboxyl group include acrylic acid, methacrylic acid, itaconic acid, crotonic acid, and maleic acid.

Specific examples of a vinyl monomer having isocyanate group include isocyanate ethylmethacrylate, and methacryloyl isocyanate.

In the method (B), azo initiators with a low hydrogen-pull effect such as azobisisobutyronitrile, azobisvaleronitrile, azobisdimethylvaleronitrile, and azobiscyclohexane carbonitrile can be employed.

The reactive silicone oil can be introduced into the branch polymer by a conventional copolymerization method when the reactive silicone oil is a radical polymerizable silicone oil.

In the case where the reactive silicone oil is a silicone oil having hydroxyl group or epoxy group as an end group thereof, for example, a double bond is introduced into the reactive silicone oil by allowing the silicone oil to react with the previously mentioned carboxyl-group-containing vinyl monomer or isocyanate-group-containing vinyl monomer, and then the silicone oil is copolymerized with a vinyl monomer; or the previously mentioned reactive silicone oil is allowed to react with a copolymer of the carboxyl-group-containing or isocyanate-group-containing vinyl monomer.

Predetermined catalysts can employed for the reaction between the hydroxyl group or epoxy group of the above-mentioned reactive silicone oil and the carboxyl group or isocyanate group of the above-mentioned vinyl monomer.

When synthesizing the cellulose-modified polymer for use in the present invention, about 5 to 80 wt.%, preferably about 10 to 50 wt.%, of cellulose and/or cellulose derivative, with the elimination of water therefrom if necessary, about 1 to 60 wt.%, preferably about 5 to 40 wt.%, of the reactive silicone oil, and about 10 to 85 wt.% of one kind or more kinds of vinyl monomers are employed.

In the thermal image transfer recording medium provided with a heat resistant protective layer which comprises the cellulose-modified polymer comprising (a) the cellulose and/or cellulose derivative as a backbone polymer, and (b) a copolymer of the reactive silicone oil and the vinyl monomer serving as a branch polymer, the silicone component is chemically bonded to the cellulose and/or cellulose derivative and the vinyl monomer, so that the silicone component is not transferred into the ink layer when allowed to stand at high temperatures or preserved for an extended period of time, and therefore non-uniform image transfer, and image transfer with non-printed portions can be advantageously prevented.

Furthermore, since the silicone component is present in the branch polymer of the cellulose-modified polymer, when the cellulose-modified polymer forms a film serving as the heat resistant protective layer, the silicone component tends to be present at the surface of the heat resistant protective layer, so that the occurrence of the, sticking phenomenon and blocking phenomenon can be effectively prevented. In order to cause the heat resistant protective layer to exhibit this effect sufficiently for use in practice, it is preferable that the amount of the reactive silicone oil be 10 wt.% or more in the entire amount of the cellulose-modified polymer.

In order to prevent the sticking phenomenon which may occur during thermal image transfer recording by use of high-speed printers when thermal head temperature is high, it is preferable to employ a cellulose-modified polymer which comprises a cellulose and/or cellulose derivative with a softening point of 150° C. or more serving as the backbone polymer and a copolymer of a reactive silicone oil and a monomer serving as the branch polymer.

When the surface portion of the heat resistant protective layer is scraped off the heat resistant protective layer by the friction with a thermal head and the scraped components are fused and adhere to a heating element of the thermal head and its vicinity, the printing quality is significantly degraded. In order to prevent this, it is preferable to employ a cellulose-modified polymer which has not only the above-mentioned softening point of 150° C. or more, but also a film strength of 12 mN or more.

It is preferable that the heat resistant protective layer have a thickness in the range of about 0.01 to 2.00 μm, more preferably in the range of 0.05 to 0.75 μm.

Production Example 1

Production of Cellulose-modified Polymer

In a 500 ml flask equipped with a stirrer, a thermometer, a condenser, and a nitrogen-gas introducing tube, 30 parts by weight of cellulose acetate (Trademark "L-AC" made by Daicel Chemical Industries, Ltd.), 65 parts by weight of methyl methacrylate, 5 parts by weight of a silicone macromonomer with a molecular weight of about 5000 (Trademark "AK-5" made by Toagosei Chemical Industry Co., Ltd.), 0.5 parts by weight of t-butyl peroxyisopropylcarbonate (Trademark "BIC-75" made by Kayaku Akzo Co., Ltd.), and 20 parts by weight of methyl isopropyl ketone were placed.

The above reaction mixture was stirred at 80° C. for 4 hours. To this reaction mixture, a solution consisting of 0.05 parts by weight of BIC-75 and 30 parts by weight of methyl isobutyl ketone was added, and the reaction mixture was further stirred at 80° C. for 4 hours, whereby a milky white solution with a solid component content of 33 wt.% was obtained. The thus obtained solution was referred to as resin solution A.

Production Example 2

Production of Cellulose-modified Polymer

In a 500 ml flask equipped with a stirrer, a thermometer, a condenser, and a nitrogen-gas introducing tube, 20 parts by weight of cellulose acetate butyrate (Trademark "CAB-381-01" made by Eastman Kodak Co.), 50 parts by weight of methyl methacrylate, 30 parts by weight of a silicone macromonomer with a molecular weight of about 5000 (Trademark "AK-5" made by Toagosei Chemical Industry Co., Ltd.), 0.5 parts by weight of t-butyl peroxyisopropylcarbonate (Trademark "BIC-75" made by Kayaku Akzo Co., Ltd.).

The above reaction mixture was stirred at 80° C. for 4 hours. To this reaction mixture, a solution consisting of 0.05 parts by weight of BIC-75 and 30 parts by weight of methyl isobutyl ketone was added, and the reaction mixture was further stirred at 80° C. for 4 hours, whereby a milky white solution with a solid component content of 33 wt.% was obtained. The thus obtained solution was referred to as resin solution B.

Production Example 3

Production of Cellulose-modified Polymer

In a 500 ml flask equipped with a stirrer, a thermometer, a condenser, and a nitrogen-gas introducing tube, 100 parts by weight of ethyl cellulose (Trademark "N-14" made by Hercules Inc.), and 400 parts by weight of toluene were placed. This mixture was subjected to azeotropy for 4 hours, whereby ethyl cellulose was dehydrated.

To 100 parts by weight of a 20 % toluene solution of the dehydrated ethyl cellulose, 90 parts by weight of the dehydrated ethyl cellulose, 90 parts by weight of methyl isobutyl ketone and 1 part by weight of methacryloyl isocyanate were added, and the mixture was stirred at room temperature for 30 minutes, whereby an unsaturated double bond was introduced into the ethyl cellulose.

To the thus obtained reaction mixture, 20 parts by weight of a reactive silicone oil with a molecular weight of 1000 (Trademark "FM-0711" made by Chisso Corporation, 50 parts by weight of methyl methacrylate, 10 parts by weight of methyl methacrylate, and 1 part by weight of azobisisobutyronitrile were added.

The above reaction mixture was stirred at 80° C. for 4 hours. To this reaction mixture, a solution consisting of 0.05 parts by weight of azobisisobutyronitrile and 30 parts by weight of toluene was added, and the reaction mixture was further stirred at 80° C. for 4 hours, whereby a light yellow transparent solution with a solid component content of 33 wt.% was obtained. The thus obtained solution was referred to as resin solution C.

Production Example 4

Production of Cellulose-modified Polymer

Cellulose acetate butylate (Trademark "CAB-553-04" made by Eastman Kodak Co.) was dehydrated in the same manner as in Production Example 3, so that a 20% methyl isobutyl ketone solution of cellulose acetate butyrate was obtained.

To 170 parts by weight of the thus obtained 20% methyl isobutyl ketone solution of cellulose acetate butylate, 40 parts by weight of methyl methacrylate, 10 parts by weight of methacrylic acid, 40 parts by weight of methyl isobutyl ketone, and 1 part by weight of benzoyl peroxide were added, and the mixture was stirred at 100° C. for 4 hours.

To this reaction mixture, a solution consisting of 0.05 parts by weight of benzoyl peroxide and 30 parts by weight of methyl isobutyl ketone was added, and the reaction mixture was stirred at 80° C. for 4 hours.

To the thus obtained mixture, 10 parts by weight of the reactive silicone oil with the previously mentioned formula (II) and 0.5 parts by weight of tetramethylammonium chloride serving as a catalyst were added.

The above reaction mixture was stirred at 90° C. for 8 hours, whereby a solution with a solid component content of 34 wt.% was obtained. The thus obtained resin resolution was referred to as resin solution D.

It was confirmed that the silicone oil was introduced into the resin skeleton from the reduction of the acid value thereof and NMR measurement.

Production Example 5

Production of Cellulose-modified Polymer

The procedure of producing the resin solution B in Production Example 2 was repeated except that BIC-75 serving as the initiator was replaced by azobisisobutyronitrile, whereby an opaque solution with a solid component content of 33 wt.% was obtained. The thus obtained solution was referred to as resin solution E.

As the material for the support for the thermal image transfer recording medium according to the present invention, films of polycarbonate, polyallylate, polyetherimide, polysulfone, polyphenyl ether, polyamide imide, polyimide, polyethylene naphthalate, polyphenylsulfide, polyether ether ketone, and fluoro-plastics; and films of polyethylene terephthalate, polybutylene terephthalate, polybutylene naphthalate, polyethylene, polypropylene, polystyrene, polyvinyl chloride, polyvinylidene chloride, and nylon, can be employed.

Biaxially oriented films are preferable as the support for use in the present invention.

In the present invention, as the thermal image transfer ink layer, the conventional thermal fusing image transfer ink layer and sublimation thermal image transfer ink layer can be used as they are, and there are no particular limitations on the thermal image transfer ink layer for use in the present invention. The thermal image transfer ink layer for use in the present invention may comprise a coloring agent, a wax component, a resin component, and additives such as a lubricant and a surfactant.

Specific examples of a coloring agent for use in the thermal image transfer ink layer include pigments and dyes such as carbon black, red oxide, Lake Red C, Fast Sky Blue, Benzidine Yellow, Phthalocyanine Green, Phthalocyanine Blue, direct dyes, oil dyes, and basic dyes.

Specific examples of a wax component for use in the thermal image transfer ink layer include natural waxes such as carnauba wax, auricury wax, canderilla wax, Japan wax, cane wax, montan wax, ozokerite, microcrystalline wax, sersine wax, and paraffin wax; synthetic waxes such as Fischer Tropsch wax, low-molecular-weight polyethylene, oxidized wax, and hydrogenated wax.

Specific examples of a resin component for use in the thermal image transfer ink layer include vinyl resins such as polyacrylic acid, polyacrylate, polymethacrylic acid, polymethacrylate, polyacrylamide, polystyrene, polyvinyl acetate, polyvinyl alcohol, polyvinyl butyral, polyvinyl pyrrolidone, polyvinyl chloride, and polyvinylidene chloride; cellulose resins such as ethyl cellulose, hydroxyethyl cellulose, ethylhydroxy cellulose, hydroxypropyl cellulose, methyl cellulose, and cellulose acetate; polyester resin; polyacetal resin; epoxy resin; terpene resin; rosin resin; fluoroplastics; and silicone resin.

Specific examples of an additive for use in the thermal image transfer layer include fatty acids, metallic salts of fatty acids, esters of fatty acids, fatty acid amides, inorganic salts, nonionic surfactants, cationic surfactants, anionic surfactants, and ampholytic surfactants. There are no particular limitations on the additive for use in the thermal image transfer layer. Furthermore, there are no particular limitations on the method of producing the thermal image transfer ink layer.

The features of this invention will become apparent in the course of the following description of exemplary embodiments which are given for illustration of the invention and are not intended to be limiting thereof.

Example 1

A 4% methyl ethyl ketone/cyclohexanone (9/1) solution of the resin solution A produced in Production Example 1 was coated on the back side of a polyethylene terephthalate (PET) film with a thickness of about 4.5 μm by a wire bar, and dried at 90° C. for 30 seconds, whereby a heat resistant protective layer with a thickness of about 0.5 μm was provided.

The softening point of the resin contained in the resin solution A measured by a thermal mechanical analyzer made by Seiko Instruments Inc. was 140° C.

The film strength of the heat resistant protective layer measured by CSR 02 scratch strength tester made by Rhesca Co., Ltd. was 100 mN.

A dispersion with the following formulation for the formation of a thermal fusing type image transfer ink layer was coated on the front side of the PET film opposite to the heat resistant protective layer with respect to the PET film and dried, whereby a thermal fusing type image transfer ink layer with a deposition of about 2.8 g/m$^2$ on a dry basis was formed on the front side of the PET film:

| | Parts by Weight |
|---|---|
| Carnauba wax | 6 |
| Paraffin wax | 8 |
| Carbon black | 4 |
| Toluene | 82 |

Thus, a thermal image transfer recording medium No. 1 of the present invention was prepared.

Example 2

A 5% methyl ethyl ketone/cyclohexanone (9/1) solution of the resin solution B produced in Production Example 2 was coated on the back side of a polyethylene terephthalate (PET) film with a thickness of about 4.5 μm by a wire bar, and dried at 90° C. for 30 seconds, whereby a heat resistant protective layer with a thickness of about 0.5 μm was provided.

The softening point of the resin contained in the resin solution B and the film strength of the heat resistant protective layer measured in the same manner as in Example 1 were respectively 156° C. and 13 mN.

The same dispersion as used in Example 1 for the formation of a thermal fusing type image transfer ink layer was coated on the front side of the PET film opposite to the heat resistant protective layer with respect to the PET film and dried, whereby a thermal fusing type image transfer ink layer with a deposition of about 2.8 g/m$^2$ on a dry basis was formed on the front side of the PET film. Thus, a thermal image transfer recording medium No. 2 of the present invention was prepared.

Example 3

A 4% methyl ethyl ketone solution of the resin solution C produced in Production Example 3 was coated on the back side of a polyethylene terephthalate (PET) film with a thickness of about 4.5 μm by a wire bar, and dried at 60° C. for 10 seconds, whereby a heat resistant protective layer with a thickness of about 0.5 μm was provided.

The softening point of the resin contained in the resin solution C and the film strength of the heat resistant protective layer measured in the same manner as in Example 1 were respectively 170° C. and 14 mN.

The same dispersion as used in Example 1 for the formation of a thermal fusing type image transfer ink layer was coated on the front side of the PET film opposite to the heat resistant protective layer with respect to the PET film and dried, whereby a thermal fusing type image transfer ink layer with a deposition of about 2.8 g/m$^2$ on a dry basis was formed on the front side of the PET film. Thus, a thermal image transfer recording medium No. 3 of the present invention was prepared.

Example 4

A 5% methyl ethyl ketone/cyclohexanone (9/1) solution of the resin solution D produced in Production Example 4 was coated on the back side of a polyethylene terephthalate (PET) film with a thickness of about 4.5 μm by a wire bar, and dried at 90° C. for 30 seconds, whereby a heat resistant protective layer with a thickness of about 0.5 μm was provided.

The softening point of the resin contained in the resin solution D and the film strength of the heat resistant protective layer measured in the same manner as in Example 1 were respectively 165° C. and 16 mN.

The same dispersion as used in Example 1 for the formation of a thermal fusing type image transfer ink layer was coated on the front side of the PET film opposite to the heat resistant protective layer with respect to the PET film and dried, whereby a thermal fusing type image transfer ink layer with a deposition of about 2.8 g/m$^2$ on a dry basis was formed on the front side of the PET film. Thus, a thermal image transfer recording medium No. 4 of the present invention was prepared.

Example 5

A 7 % methyl ethyl ketone/cyclohexanone (9/1) solution of the resin solution B produced in Production Example 2 was coated on the back side of a polyethylene terephthalate (PET) film with a thickness of about 6.0 μm by a wire bar, and dried at 90° C. for 30 seconds, whereby a heat resistant protective layer with a thickness of about 0.7 μm was provided.

The film strength of the heat resistant protective layer measured in the same manner as in Example 1 was 13 mN.

A dispersion with the following formulation for the formation of a sublimation thermal image transfer ink layer was coated on the front side of the PET film opposite to the heat resistant protective layer with respect to the PET film and dried, whereby a sublimation thermal image transfer ink layer with a deposition of about 0.8 g/m$^2$ on a dry basis was formed on the front side of the PET film:

| | Parts by Weight |
|---|---|
| MS Red G | 6 |
| Polyvinyl butyral | 5 |
| 1,4-dioxanone | 55 |
| Toluene | 17 |
| Methyl ethyl ketone | 17 |

Thus, a thermal image transfer recording medium No. 5 of the present invention was prepared.

Example 6

A 6% methyl ethyl ketone solution of the resin solution C produced in Production Example 3 was coated on the back side of a polyethylene terephthalate (PET) film with a thickness of about 6.0 μm by a wire bar, and dried at 60° C. for 20 seconds, whereby a heat resistant protective layer with a thickness of about 0.6 μm was provided.

The film strength of the heat resistant protective layer measured in the same manner as in Example 1 was 14 mN.

The same dispersion as used in Example 5 for the formation of a sublimation thermal image transfer ink layer was coated on the front side of the PET film opposite to the heat resistant protective layer with respect to the PET film and dried, whereby a sublimation thermal image transfer ink layer with a deposition of about 0.8 g/m$^2$ on a dry basis was formed on the front side of the PET film. Thus, a thermal image transfer recording medium No. 6 of the present invention was prepared.

Example 7

A 7% methyl ethyl ketone/cyclohexanone (9/1) solution of the resin solution D produced in Production Example 4 was coated on the back side of a polyethylene terephthalate (PET) film with a thickness of about 6.0 μm by a wire bar, and dried at 90° C. for 30 seconds, whereby a heat resistant protective layer with a thickness of about 0.6 μm was provided.

The film strength of the heat resistant protective layer measured in the same manner as in Example 1 was 16 mN.

The same dispersion as used in Example 5 for the formation of a sublimation thermal image transfer ink layer was coated on the front side of the PET film opposite to the heat resistant protective layer with respect to the PET film and dried, whereby a sublimation thermal image transfer ink layer with a deposition of about 0.8 g/m$^2$ on a dry basis was formed on the front side of the PET film. Thus, a thermal image transfer recording medium No. 7 of the present invention was prepared.

Example 8

A 7% methyl ethyl ketone/cyclohexanone (9/1) solution of the resin solution E produced in Production Example 5 was coated on the back side of a polyethylene terephthalate (PET) film with a thickness of about 6.0 μm by a wire bar, and dried at 90° C. for 60 seconds, whereby a heat resistant protective layer with a thickness of about 0.6 μm was provided.

The softening point of the resin contained in the resin solution E and the film strength of the heat resistant protective layer measured in the same manner as in Example 1 were respectively 120° C. and 2 mN.

The same dispersion as used in Example 5 for the formation of a sublimation thermal image transfer ink layer was coated on the front side of the PET film opposite to the heat resistant protective layer with respect to the PET film and dried, whereby a sublimation thermal image transfer ink layer with a deposition of about 0.8 g/m$^2$ on a dry basis was formed on the front side of the PET film. Thus, a thermal image transfer recording medium No. 8 of the present invention was prepared.

Comparative Example 1

A 5% methyl ethyl ketone/toluene (5/5) solution of ethyl cellulose/alcohol-modified silicone oil (90/10) was coated on the back side of a polyethylene terephthalate (PET) film with a thickness of about 4.5 μm by a wire bar, and dried at 90° C. for 30 seconds, whereby a heat resistant protective layer with a thickness of about 0.5 μm was provided.

The same dispersion as used in Example 1 for the formation of a thermal fusing type image transfer ink opposite to the heat resistant protective layer with respect to the PET film and dried, whereby a thermal fusing type image transfer ink layer with a deposition of about 2.8 g/m$^2$ on a dry basis was formed on the front side of the PET film. Thus, a comparative thermal image transfer recording medium No. 1 was prepared.

Comparative Example 2

A 5% methyl ethyl ketone/methyl isobutyl ketone (8/2) solution of a copolymer of a reactive silicone oil with a molecular weight of 10,000 (Trademark "FM-0725" made by Chisso Corporation)/methyl methacrylate (30/70) was coated on the back side of a PET film with a thickness of about 4.5 μm by a wire bar, and dried at 90° C. for 30 seconds, whereby a heat resistant protective layer with a thickness of about 0.5 μm was provided.

The same dispersion as used in Example 1 for the formation of a thermal fusing type image transfer ink layer was coated on the front side of the PET film opposite to the heat resistant protective layer with respect to the PET film and dried, whereby a thermal fusing type image transfer ink layer with a deposition of about 2.8 g/m$^2$ on a dry basis was formed on the front side of the PET film. Thus, a comparative thermal image transfer recording medium No. 2 was prepared. transfer recording medium No. 2 was prepared.

Comparative Example 3

A 7% methyl ethyl ketone/toluene (5/5) solution of ethyl cellulose/alcohol-modified silicone oil (90/10) was coated on the back side of a polyethylene terephthalate (PET) film with a thickness of about 6.0 μm by a wire bar, and dried at 90° C. for 30 seconds, whereby a heat resistant protective layer with a thickness of about 0.6 μm was provided.

The same dispersion as used in Example 5 for the formation of a sublimation thermal image transfer ink layer was coated on the front side of the PET film opposite to the heat resistant protective layer with respect to the PET film and dried, whereby a sublimation thermal image transfer ink layer with a deposition of about 0.8 g/m$^2$ on a dry basis was formed on the front side of the PET film. Thus, a comparative thermal image transfer recording medium No. 3 was prepared.

Comparative Example 4

A 7% methyl ethyl ketone/methyl isobutyl ketone (8/2) solution of a copolymer of a reactive silicone oil with a molecular weight of 10,000 (Trademark "FM-0725" made by Chisso Corporation)/methyl methacrylate (30/30) was coated on the back side of a PET film with a thickness of about 6.0 μm by a wire bar, and dried at 90° C. for 30 seconds, whereby a heat resistant protective layer with a thickness of about 0.6 μm was provided.

The same dispersion as used in Example 5 for the formation of a sublimation thermal image transfer ink layer was coated on the front side of the PET film opposite to the heat resistant protective layer with respect to the PET film and dried, whereby a sublimation thermal image transfer ink layer with a deposition of about 0.8 g/m$^2$ on a dry basis was formed on the front side of the PET film. Thus, a comparative thermal image transfer recording medium No. 4 was prepared.

The above prepared thermal image transfer recording media No. 1 to No. 8 of the present invention and comparative thermal image transfer recording media No. 1 to No. 4 were evaluated by performing printing operation with respect to (1) anti-sticking performance, (2) antiblocking performance, (3) transfer of the heat resistant protective layer to the thermal image transfer ink layer, and (4) smearing of a thermal head employed.

Specific methods for the above evaluations and evaluation standards are as follows:

(1) Anti-sticking performance The evaluation was performed by using any of the following thermal fusing type printers and sublimation printer under the following conditions:

(A-1) Thermal fusing type printer: Trademark "TEC B-30" made by Tokyo Electric Company, Ltd. Printing was conducted under the conditions that printing energy was 25 mJ/mm$^2$ and printing speed was 2"/sec.

(A-2) Thermal fusing type printer: Trademark "SWEDOT 196" made by UBI Co., Ltd. Printing was conducted under the conditions that printing energy was 23 mJ/mm$^2$and printing speed was 7"/sec.

(B) Sublimation Printer: Sharp Color Video Printer GZ-P11 Printing was conducted with the application of 14 V for image transfer.

Evaluation Standards:

◎: No sticking, and stable transfer of recording medium.

○: Almost no sticking.

Δ: Slight sticking.

x: Considerable sticking and no transfer of recording medium.

(2) Blocking preventing performance

1. The ink layer was superimposed on the heat resistant protective layer and was allowed to stand at 40° C. for 72 hours, with the application of a pressure of 4.0 kg/cm$^2$thereto. The degree of the transfer of the ink layer to the heat resistant protective layer was visually inspected when the ink layer was peeled off the heat resistant protective layer.

2. The ink layer was superimposed on the heat resistant protective layer and was allowed to stand at 50° C. for 72 hours, with the application of a pressure of 4.0 kg/cm$^2$ thereto. The degree of the transfer of the ink layer to the heat resistant protective layer was visually inspected when the ink layer was peeled off the heat resistant protective layer.

Evaluation Standards

○: No transfer by blocking.

Δ: Slight transfer by blocking.

x: Conspicuous transfer.

(3) Transfer of heat resistant protective layer to ink layer

The ink layer was superimposed on the heat resistant protective layer and allowed to stand at room temperature for 72 hours, with the application of a pressure of 4.0 kg/cm$^2$, and the transfer of the heat resistant protective layer to the ink layer was evaluated by use of any of the following thermal fusing type printer and sublimation printer:

(A) Thermal fusing type printer: Intermec 8646 Printing was conducted with the application of the standard image transfer energy (about 17 mJ/mm$^2$) of Intermec 8646 on each of the recording media samples without superimposing the ink layer on the heat resistant protective layer, and image quality was compared with that obtained when the ink layer was superimposed on the heat resistant protective layer under the above-mentioned conditions.

(B) Sublimation Printer: Sharp Color Video Printer GZ-P11 Printing was conducted with the application of 12 V for image transfer on each of the recording media samples without superimposing the ink layer on the heat resistant protective layer, and image quality was compared with that obtained when the ink layer was superimposed on the heat resistant protective layer under the above-mentioned conditions.

Evaluation Standards:

○: Exactly the same images were obtained.

Δ: Non-printed portions and non-uniform image transfer were slightly observed.

x: Non-printed portions and non-uniform image transfer were conspicuously observed.

(4) Smearing of Thermal Head

By use of any of the following printers, image transfer was continuously conducted on each sample of the thermal image transfer recording media up to a length of 500 in total, so that the smearing of the thermal head of the printer was visually inspected, and the printed image quality at the first printing was compared with that at the last printing:

(A-1) Thermal fusing type printer: Trademark "TEC B-30" made by Tokyo Electric Company, Ltd. Printing was conducted under the conditions that printing energy was 20 mJ/mm$^2$ and printing speed was 4"/sec.

(A-2) Thermal fusing type printer: Trademark "SWEDOT 196" made by UBI Co., Ltd. Printing was conducted under the conditions that printing energy was 22 mJ/mm$^2$ and printing speed was 7"/sec.

(B) Sublimation Printer: Sharp Color Video Printer GZ-P11. Printing was conducted with the application of 12 V for image transfer.

Evaluation Standards:

○: The thermal head was not smeared at all.

Δ: The thermal head was slightly smeared, and printing quality was slightly lowered in the course of the printing process.

x: The thermal head was considerably smeared, and printing quality was greatly lowered in the course of the printing process.

TABLE 1

| | Anti-sticking performance | | | Anti-blocking performance | | Transfer to ink layer | | Smearing of thermal head | | |
|---|---|---|---|---|---|---|---|---|---|---|
| | A-1 | A-2 | B | 1 | 2 | A | B | A-1 | A-2 | B |
| Ex. 1 | ◎ | ○ | — | ○ | ○ | ○ | — | ○ | Δ | — |
| Ex. 2 | ◎ | ◎ | — | ○ | ○ | ○ | — | ○ | ○ | — |
| Ex. 3 | ◎ | ◎ | — | ○ | ○ | ○ | — | ○ | ○ | — |
| Ex. 4 | ◎ | ◎ | — | ○ | ○ | ○ | — | ○ | ○ | — |
| Ex. 5 | — | — | ◎ | ○ | ○ | — | ○ | — | — | ○ |
| Ex. 6 | — | — | ◎ | ○ | ○ | — | ○ | — | — | ○ |
| Ex. 7 | — | — | ◎ | ○ | ○ | — | ○ | — | — | ○ |
| Ex. 8 | — | — | ○ | ○ | ○ | — | ○ | — | — | Δ |
| Comp. Ex. 1 | ○ | Δ | — | ○ | ○ | x | — | x | x | — |
| Comp. Ex. 2 | ○ | ○ | — | ○ | ○ | ○ | — | x | x | — |
| Comp. Ex. 3 | — | — | Δ | ○ | ○ | — | x | — | — | x |
| Comp. Ex. 4 | — | — | ○ | ○ | ○ | — | ○ | — | — | x |

The results shown in the above Table 1 indicate that the thermal image transfer recording media of the present invention are excellent in the anti-sticking performance and anti-blocking performance, have thermal sensitivity suitable for high speed printers, and do not cause the transfer of the heat resistant protective layer to the ink layer, and do not smear the thermal head.

In particular, when cellulose acetate butyrate or ethyl cellulose is employed as the cellulose derivative used as the backbone polymer for the cellulose-modified polymer for use in the heat resistant protective layer, excellent anti-sticking performance and anti-blocking performance are obtained, and the smearing of a thermal head can be effectively prevented.

When the reactive silicone oil for use in the cellulose-modified polymer is used in an amount of 10 wt.% or more with respect to the entire weight of the cellulose-modified polymer, the anti-sticking performance can be further improved.

When the cellulose-modified polymer has a softening point of 150° C. or more, the thermal image transfer recording medium becomes more suitable for use in high speed printers, and the smearing of the thermal head employed is effectively prevented.

When the heat resistant protective layer has a film strength of 12 mN or more, the scraping of a surface portion of the heat resistant protective layer is effectively prevented and therefore the smearing of the thermal head is more effectively prevented.

Japanese Patent Application 5-084016 filed on Mar. 17, 1993 is hereby incorporated by reference.

What is claimed is:

1. A thermal image transfer recording medium, comprising:

a support, a thermal image transfer ink layer formed thereon, and a heat resistant protective layer which comprises a cellulose-modified polymer with a backbone polymer thereof being cellulose, cellulose ester, cellulose ether, or mixtures thereof and a branched polymer thereof being a copolymer of a reactive silicone oil and a vinyl monomer, and which is formed on the back side of said support opposite to said thermal image transfer ink layer with respect to said support.

2. The thermal image transfer recording medium as claimed in claim 1, wherein said cellulose derivative is cellulose acetate butyrate.

3. The thermal image transfer recording medium as claimed in claim 1, wherein said cellulose derivative is ethyl cellulose.

4. The thermal image transfer recording medium as claimed in claim 1, wherein said reactive silicone oil is in an amount of 10 wt.% of the entire weight of said cellulose-modified polymer.

5. The thermal image transfer recording medium as claimed in claim 1, wherein said cellulose-modified polymer has a softening point of 150° C. or more.

6. The thermal image transfer recording medium as claimed in claim 1, wherein said heat resistant protective layer has a film strength of 12 mN or more.

7. The thermal image transfer recording medium as claimed in claim 1, wherein said cellulose ester is cellulose acetate, cellulose acetate propionate or cellulose acetate butyrate.

8. The thermal image transfer recording medium as claimed in claim 1, wherein said cellulose ether is ethyl cellulose, hydroxyethyl cellulose, ethylhydroxy ethyl cellulose, hydroxypropyl cellulose, hydroxypropyl ethyl cellulose, carboxymethyl cellulose or carboxymethylethyl cellulose.

* * * * *

UNITED STATES PATENT AND TRADEMARK OFFICE

CERTIFICATE OF CORRECTION

PATENT NO. : 5,409,884

DATED : April 25, 1995

INVENTOR(S) : Shigeyuki Haraka et al

It is certified that error appears in the above-identified patent and that said Letters Patent is hereby corrected as shown below:

| Col. | Line | |
|---|---|---|
| 2, | 42, | please delete "ant" and insert --anti--. |
| 6, | 7, | please insert --be-- after "can"; |
| 6, | 41, | please delete "," after --the--. |
| 7, | 68, | please insert --)-- "after ration,". |
| 8, | 15, | please delete "butylate" and insert --butyrate--. |
| 13, | 12, | please delete "transfer recording medium No. 2.". |
| 15, | 10, | please delete "in" and insert --m--. |

Signed and Sealed this

Ninth Day of April, 1996

Bruce Lehman

*Attest:*

BRUCE LEHMAN

*Attesting Officer*

*Commissioner of Patents and Trademarks*